US005111558A

United States Patent [19]

Ridley et al.

[11] Patent Number: 5,111,558

[45] Date of Patent: May 12, 1992

[54] DURABLE ELASTIC LACE FOR ATHLETIC SHOES

[76] Inventors: Stephen F. Ridley, 600 Araphoe St. #6, Boulder, Colo. 80302; Louis T. Sicotte, 3107 Kingsridge Blvd., Boulder, Colo. 80301

[21] Appl. No.: 712,072

[22] Filed: Jun. 7, 1991

[51] Int. Cl.[5] ..... A43C 9/00

[52] U.S. Cl. ..... 24/715.3; 24/300

[58] Field of Search ..... 24/715.2, 715.4, 715.5, 24/713.3, 713.6, 713.8, 714.1, 714.3, 300, 301

[56] References Cited

U.S. PATENT DOCUMENTS

| | | | |
|---|---|---|---|
| 1,358,753 | 11/1920 | Killam et al. | 24/715.3 |
| 1,566,466 | 12/1925 | Cleaver | 24/300 |
| 1,667,276 | 4/1928 | Weingarten | 24/715.3 |
| 1,673,080 | 6/1928 | Lamy | 24/715.3 |
| 1,673,327 | 6/1928 | Hahn | 24/715.3 |
| 1,740,506 | 12/1929 | Grosser | 24/715.3 |
| 1,775,013 | 9/1930 | Yugawa | 24/715.3 |
| 1,823,057 | 9/1931 | Marx | 24/715.3 |
| 2,004,702 | 6/1935 | Luttman, Jr. | 24/715.3 |
| 2,031,375 | 2/1936 | Lilley | 24/715.3 |
| 4,144,621 | 3/1979 | Green | 24/715.4 |
| 4,423,539 | 1/1984 | Ivanhoe | 24/143 |
| 4,930,196 | 6/1990 | Laurin | 24/715.3 |
| 5,023,982 | 6/1991 | Mehan | 24/715.3 |
| 5,029,372 | 7/1991 | Brinson | 24/715.3 |

FOREIGN PATENT DOCUMENTS

| | | | |
|---|---|---|---|
| 0024631 | 10/1883 | Fed. Rep. of Germany | 24/712.3 |

*Primary Examiner*—Victor N. Sakran

*Attorney, Agent, or Firm*—Dorr, Carson, Sloan & Peterson

[57] ABSTRACT

A lace for shoes that provide uniform pressure on the shoe and wearer through a wide range of foot movement and stress levels while having a relatively long life. The lace is formed from a material having a combination of high tensile strength, tear strength, abrasion resistance, resistance to environmental degradation and other factors while providing resilient elasticity. The movement of the foot is allowed to naturally occur without restriction from the laces.

13 Claims, 1 Drawing Sheet

DURABLE ELASTIC LACE FOR ATHLETIC SHOES

BACKGROUND OF THE INVENTION

1. Field of the Invention

The present invention relates to the field of laces for athletic shoes to enhance durability and comfort during the wearing of the shoes.

2. Statement of the Problem

Shoe laces are used to attach shoes to the feet of the individual wearing the shoes by conforming the upper portion of the shoe to the shape of the upper arch of the wearer and securing the shoe, typically by a knot, thereon. Normally, the wearer will tighten the lace so there is a pressure applied by the lace on the upper portion of the wearer's foot. However, the foot is at rest at the moment when the lace is tightened and tied. As the wearer begins to move, the foot inside the shoe undergoes a range of movement. These movements apply varying degrees of stress between the foot and the shoe. Most laces are either inelastic or have a limited range of elasticity. This combination of inelasticity of the lace and the stress between the foot and shoe creates pressure points on the foot and causes discomfort and possibly pain to the wearer. The foot is restricted from undergoing a natural range of motion by the increased tension from the lace. Even when the prior art laces would stretch, usually the range of elasticity would be exceeded so the lace is no longer resilient and the shoe becomes loose on the foot.

There have been a number of prior approaches to elastic laces. One approach utilized rubber shoe laces to alleviate the need to tie knots in the laces, as disclosed in U.S. Pat. No. 1,566,466 issued to Cleaver; U.S. Pat. No. 1,673,080 issued to Lamy; U.S. Pat. No. 1,667,276 issued to Weingarten; U.S. Pat. No. 1,740,506 issued to Grosser; U.S. Pat. No. 1,775,013 issued to Yugawa; U.S. Pat. No. 1,823,057 issued to Marx; and U.S. Pat. No. 2,004,702 issued to Luttman, Jr. These laces were formed from solid rubber which allowed some elasticity to allow the shoes to be slipped on and off without the necessity for retying or anchoring the ends of the laces. However, these laces had a relatively short life span due to the low abrasion resistance, limited elasticity, low tear strength and other factors. As the laces were stretched, the eyelets of the shoe and other parts of the shoe would cause abrasion of the laces leading to catastrophic failure of the lace. The rubber laces are also susceptible to environmental degradation, thus shortening the life span of the lace. Further, rubber laces are difficult to tie in knots, and once the knots are tied, even more difficult to untie.

Other approaches used a rubber inner lace with a fabric coating, but this decreased the elasticity of the lace, and was also susceptible to environmental degradation. Usually the inner elastic core breaks or loses enough elasticity to reduce its effectiveness.

One approach to overcome these problems is disclosed in U.S. Pat. No. 1,673,327, issued to Hahn. Hahn discloses using a series of short laces between opposing eyelets to decrease the abrasion and increase the life of the laces. However, this approach was only usable for a limited type of shoes, is relatively expensive and still has many of the above problems.

A modern approach to this problem is disclosed in U.S. Pat. No. 4,423,539 issued to Ivanhoe. Ivanhoe discloses a plastic lace having a plurality of spaced elastic strands covered by woven textile threads. This allows the lace to maintain its pressure even if one of the strands breaks. However, this lace still requires a textile covering to protect against abrasion and the environment.

A need still exists for a shoe lace that will provide uniform predetermined pressure through the lace regardless of the movement of the foot.

3. Solution to the Problem

The present invention solves these and other problems by providing a durable shoe lace that will enhance the comfort and performance of the wearer, particularly during athletic use.

The lace of the present invention is uniformly elastic to allow the shoe to conform to the foot of the wearer during periods of movement and non-movement.

The present invention further provides a shoe lace that is resistant to abrasion to increase the life of the lace.

The present invention provides a lace that is elastic, yet has a high tensile strength to withstand high stresses in the lace.

The present invention provides a lace that has a relatively high tear strength to resist shearing under stress.

The present invention provides a lace that is not susceptible to environmental degradation.

The present invention provides a lace that has a high level of toughness to withstand physical abuse.

These and other features will become evident from the following description of the invention taken in conjunction with the drawings.

SUMMARY OF THE INVENTION

The present invention provides a lace for shoes that provide uniform pressure on the shoe and wearer through a wide range of foot movement and stress levels while having a relatively long life. The lace is formed from a material having a combination of high tensile strength to withstand breaking, tear strength to prevent tearing at areas of imperfections, abrasion resistance to resist abrading and fraying from rubbing against the shoe, resistance to environmental degradation so not to discolor or weaken and other factors while providing resilient elasticity to maintain a set tension level regardless of the movement of the foot and shoe. The movement of the foot is allowed to naturally occur without restriction from the laces.

In one preferred embodiment the elongated lace has a rectangular shape with the ends angled for ease of insertion through shoe eyelets. The lace is formed of a thermoplastic polyurethane to provide the required properties.

These and other features of the invention will become evident from the ensuing description of a preferred embodiment and from the drawings.

DETAILED DESCRIPTION OF A PREFERRED EMBODIMENT

The present invention includes a lace for a shoe, particularly for an athletic shoe or other type of shoe designed for active use, such as in running or other sports. It is to be expressly understood that the ensuing descriptive embodiment is for explanatory purposes and is not meant to limit the scope of the claimed inventive concept.

The lace of the present invention provides a combination of high tensile strength with high elasticity so the lace can firmly secure the shoe onto the foot of the wearer while eliminating any pressure points and tightening of the shoe regardless of the movement or nonmovement of the wearer and shoe. This lace has a high degree of elasticity with the ability to resiliently maintain the pressure during times of low stress. Once the tension in the lace has been set, the lace will maintain this tension level during the wearing of the shoe. The lace of the preferred embodiment is able to stretch up to five hundred (500) times its original length before failure at a tensile strength of six thousand (6000) psi.

The lace of this invention also provides a high degree of toughness. Toughness connotes the ability to absorb a large amount of mechanical energy without failure and is indicative of the amount of physical abuse the object can withstand. In the preferred embodiment, the lace of the present invention is more than fifty percent tougher than automobile tire tread rubber and polycarbonate and three times as tough of low density polyethylene.

Another important feature of the lace of the present invention is resistance to abrasion. Laces frequently become worn or frayed due to rubbing against the eyelets of the shoe and other parts of the shoe. Even the textile coated laces of the prior art were susceptible to this abrasion. The lace of the preferred embodiment will outwear rubber by a ratio of several hundred to one and even steel by a three to one ratio.

The tear strength of the present lace is also high compared to rubber or textile coated laces. The tear strength is the ability to withstand shearing under stress at points of geometrical imperfection. The tear strength of this lace is due in part to its ability to distribute rather than to concentrate stresses at points of geometrical imperfection.

The lace of the present invention is not susceptible to environmental degradation. This is an important feature since shoes, particularly athletic shoes are worn in a wide range of environments and conditions. The prior art laces would frequently decompose and weaken after they were exposed to rain, mud, snow and other environments. Also, many of the prior art laces were formed from rubber or cotton which are susceptible to degradation from ozone and oxidation. This causes not only discoloration, but also weakening the lace itself.

Figure 1:
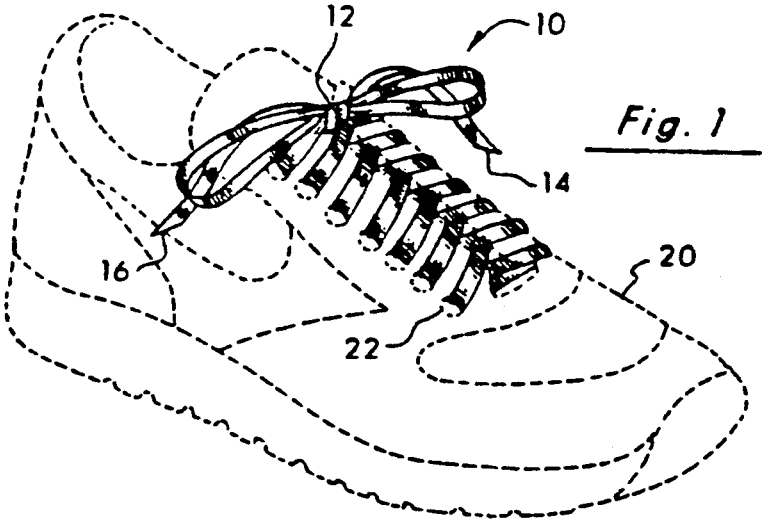
FIG. 1 is a perspective view of the lace of the present invention in an athletic shoe.
Figure 2:
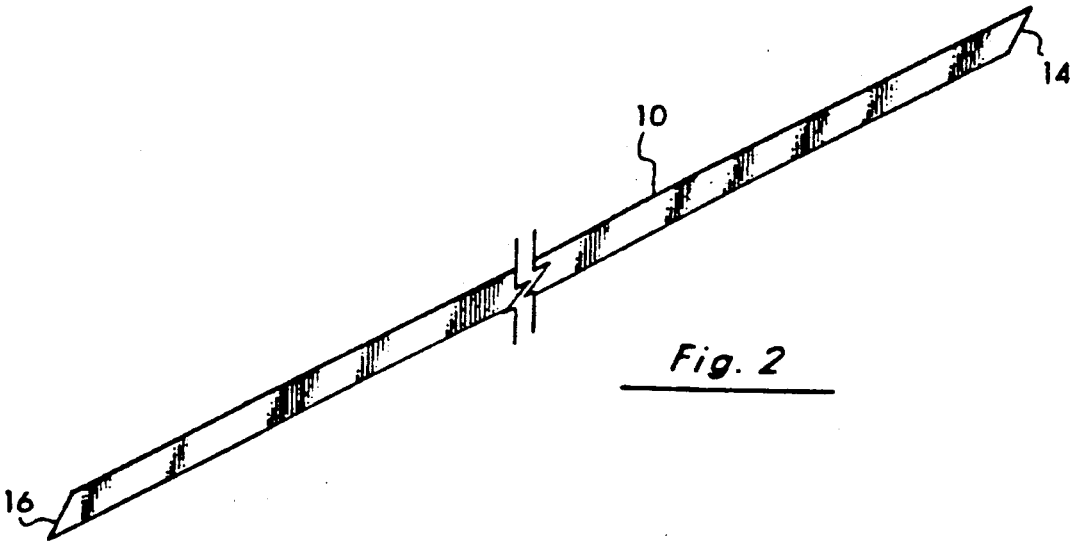
FIG. 2 is a top view of a section of the lace of the present invention.
Figure 3:
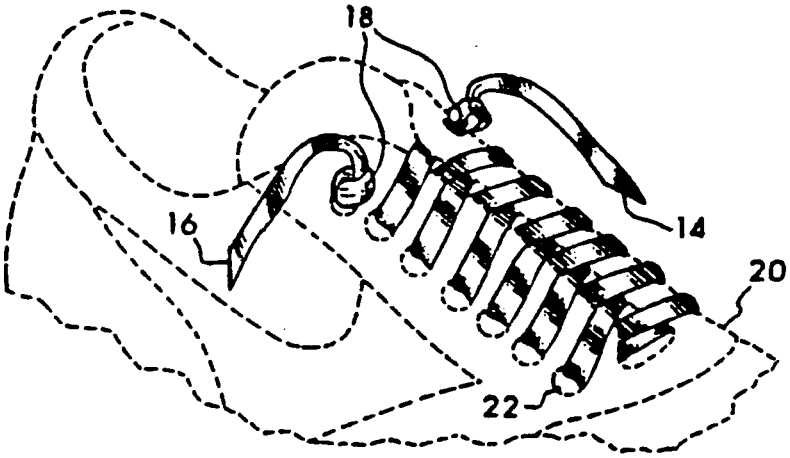
FIG. 3 is a perspective view of another method of using the lace of the present invention.

One preferred embodiment of the present invention is illustrated in FIGS. 1-3. Lace 10 is laced through eyelets 22 of shoe 20 in a conventional lacing pattern as shown in FIG. 1. Lace 10 is secured by bow knot 12 to maintain uniform pressure on the upper portion of shoe 20 to cause it to conform to the shape of the upper portion of the foot (not shown) of the wearer and to snugly hold the shoe onto the foot. As shown in FIG. 2, lace 10 has a substantially rectangular profile with each end portion 14, 16 cut an angle. The angular end portions 14, 16 assist in threading lace 10 through eyelets 22 of shoe 20.

Lace 10 of the preferred embodiment is formed from TEXIN 480-A, manufactured by Mobay Corporation, Pittsburgh, Pa. This material is a thermoplastic polyurethane. This material as used in lace 10 has a tensile strength of six thousand (6000) psi (as measured under ASTM D-412) which is greater pressure than normally applied to the human foot.

The material is highly elastic so that once the tension in the lace is set by tying the knot, the pressure will be maintained by the lace resiliently stretching as the foot undergoes a variety of movements. This reduces pressure points and discomfort on the foot and related muscles. This material has a flexural modulus of forty-five hundred (4,500) psi (as measured under ASTM D-790 at 23 degrees C.).

Lace 10 formed of this material has a hardness of 85 Shore A (as measured under ASTM D-2240) to resist holes or tears. Once a surface imperfection is formed, lace 10 will resist further tearing due to a tear strength of five hundred (500) psi, Die "C" (as measured under ASTM D-624). This is much greater than rubber, which quickly shears under stress once an imperfection occurs.

This material provides an abrasion resistance that is several times greater than steel and several hundred times greater than rubber or textiles. The Tabor Abrasion , H-18 wheel, 1000 gram load, 100 cycle (as measured under ASTM C-501) is 40 mg loss. This greatly increases the life of the lace as compared to the prior art laces.

Lace 10 formed from this material is highly resistant to oxidation and ozone degradation. Many of the prior art laces are susceptible to degradation due to oxidation and ozone, including discoloration and weakening of the lace. Also, lace 10 is not susceptible to weathering or decomposing due to the water, such as in running through water, snow or mud or in other environments and conditions.

Thus, lace 10 will have a relatively long life compared to the prior art laces due to the combination of high tensile strength, tear strength, abrasion resistance, resistance to environmental degradation and other factors while providing resilient elasticity allowing uniform pressure on the shoe and foot through a wide range of foot movement and stress levels. The movement of the foot is allowed to naturally occur without restriction from the laces.

It is to be expressly understood that this description of a preferred embodiment is for explanatory purposes only and is not meant to limit the scope of the claimed inventive concept. Other materials having most or all of the above properties is considered to be within the inventive concept as well as other shapes and configuration of lace 10 and uses of lace 10.

Shoe 20 can be easily put on the foot of the wearer by using the lace of the present invention. The foot of the wearer is initially inserted into shoe 20. Lace 10 is loosely threaded through eyelets 22 all the way up to the top of shoe 20. Then lace 10 is tightened through each eyelet 22 to the desired tightness. A knot is formed to tie lace 10 as shown in FIG. 1 to maintain this tension. The wearer can easily slip out of shoe 20 by stretching lace 10 without untying the knots. Shoe 20 can be easily put back on by the same way without having to retie the knots in lace 10.

An alternative lacing method is illustrated in FIG. 3. Lace 10 is threaded through eyelets 22 of shoe 20 as described above. However, lace 10 is knotted at each end 14, 16 of lace 10. This eliminates knot 12 across the upper arch of the foot (not shown) of the wearer to reduce the pressure formed at this point by knot 12. The wearer is still able to take shoe 20 off and put it on in the same way as above.

Lace 10 of the present invention is readily available in a variety of colors and color combinations as desired.

The present invention provides a lace for shoes that will enhance the comfort and performance of use of the shoe by allowing a firm fit without restricting the natural movement of the foot. This is of particular benefit in the use of athletic shoes, but is highly applicable to all types of shoes.

The descriptive preferred embodiment discussed above and in the drawings is not meant to limit the claimed invention. Other variations and embodiments are considered to be within the claimed inventive concept.

We claim:

1. A lace for shoes, particularly athletic shoes, said lace comprising:

a single elongated strand of elastic thermoplastic polyurethane for securing a shoe on the foot of an individual, said strand including:

means for providing constant uniform tension throughout said lace during periods of movement and non-movement of said foot;

means for resisting abrasion of said strand; and means for resisting environmental degradation of said strand.

2. The lace of claim 1 wherein said strand is formed from a material that is highly resistant to abrasion and to environmental degradation.

3. The lace of claim 2 wherein said material has a tensile strength of 6,000 psi.

4. The lace of claim 1 wherein said lace includes means for providing high fracture resistance.

5. The lace of claim 1 wherein said lace includes means for resisting tearing at points of geometrical imperfections.

6. A lace for shoes, particularly sports shoes, said lace comprising:

a single elastic strand of thermoplastic polyurethane for securing a shoe on the foot of an individual, said strand including the properties of:

high elasticity to provide constant uniform tension through said lace during periods of high stress and low stress on said shoe and foot of said wearer to allow natural movement of said foot;

high abrasion resistance to reduce wearing and fraying due to rubbing against said shoe; and high resistance to environmental degradation to reduce discoloration and weakening due to exposure to various environmental conditions.

7. The lace of claim 6 wherein said material further includes the property of:

high tear strength to reduce shearing of said lace at points of geometrical imperfection.

8. The lace of claim 6 wherein said material further includes the property of:

ability to be dyed in a variety of colors and color combinations.

9. The lace of claim 6 wherein said strand has a substantially rectangular configuration; and the ends of said strand are formed at an angle to increase the ease of insertion in the eyelets of said shoe.

10. A lace for shoes, particularly sports shoes, said lace comprising:

a single elastic strand for securing a shoe on the foot of an individual, said strand formed of thermoplastic polyurethane material including the properties of:

high elasticity to provide constant uniform tension through said lace during periods of high stress and low stress on said shoe and foot of said wearer to allow natural movement of said foot;

high abrasion resistance to reduce wearing and fraying due to rubbing against said shoe;

high resistance to environmental degradation to reduce discoloration and weakening due to expose to various environmental conditions; and high tear strength to reduce shearing of said lace at points of geometrical imperfection.

11. The lace of claim 10 wherein said material further includes the property of:

ability to be dyed in a variety of colors and color combinations.

12. The lace of claim 10 wherein said strand is formed from thermoplastic polyurethane.

13. The lace of claim 10 wherein said strand has a substantially rectangular configuration; and the ends of said strand are formed at an angle to increase the ease of insertion in the eyelets of said shoe.

* * * * *